US009038240B2

(12) United States Patent
Chen

(10) Patent No.: US 9,038,240 B2
(45) **Date of Patent: *May 26, 2015**

(54) DETACHABLE HANGER FOR COVERING OF BUILDING'S OPENING

(71) Applicant: NIEN MADE ENTERPRISE CO., LTD., Taichung (TW)

(72) Inventor: Lin Chen, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/444,360

(22) Filed: Jul. 28, 2014

(65) Prior Publication Data

US 2014/0331566 A1 Nov. 13, 2014

Related U.S. Application Data

(63) Continuation of application No. 13/788,163, filed on Mar. 7, 2013, now Pat. No. 8,869,351.

(51) Int. Cl.
*E05D 15/06* (2006.01)
*E05D 7/12* (2006.01)
(Continued)

(52) U.S. Cl.
CPC ..... *E05D 7/12* (2013.01); *E05D 15/063* (2013.01); *Y10T 16/35* (2015.01); *Y10T 16/3825* (2015.01); *Y10T 16/3813* (2015.01); *Y10T 16/3837* (2015.01); *Y10T 16/3543* (2015.01); *Y10T 16/364* (2015.01); *Y10T 16/381* (2015.01); *E05D 15/0604* (2013.01); *E05Y 2201/64* (2013.01); *E05Y 2800/70* (2013.01); *E05Y 2900/148* (2013.01); *E05Y 2900/132* (2013.01);
(Continued)

(58) Field of Classification Search
CPC ... A47H 2023/025; A47H 1/04; A47H 15/00; A47H 15/02; A47H 15/04; E06B 9/36; E06B 3/42; E06B 3/46; E06B 3/4609; E06B 3/4636; E06B 3/481; E05D 15/06; E05D 15/0621; E05D 15/0626; E05D 15/063; E05D 15/0652; E05D 15/26; E05D 15/262; E05D 15/264; E05Y 2900/131; E05Y 2900/132; E05Y 2900/142
USPC ..... 16/90, 91, 94 R, 96 R, 95 R, 97, 16/101–107, 87 R, 84 R, 87.6 R, 87.8, 273; 160/185, 199, 196.1, 195; 49/404, 409, 49/410, 411, 412, 420, 421–425, 453, 455, 49/126, 127, 128, 394, 130; 52/243.1
See application file for complete search history.

(56) References Cited

U.S. PATENT DOCUMENTS 2,957,197 A * 10/1960 Johnson, Jr. ..... 16/105
2,982,988 A * 5/1961 Blackmer ..... 16/97
3,057,005 A * 10/1962 Dishaw ..... 16/105
(Continued)

*Primary Examiner* — Chuck Mah
(74) *Attorney, Agent, or Firm* — Ming Chow; Sinorica, LLC

(57) ABSTRACT

A hanger for a sash of a window to detachably engage the sash with a rail of the window, and the hanger includes a pulley assembly and a restricting assembly. The pulley assembly has a base and a plurality of pulleys mounted on the base for rotation. The pulleys engage the rail so that the pulley assembly moves in the rail. The base is provided with a slot. The sash is provided with a rod. The rod engages the slot of the pulley assembly to engage the sash with the rail, and the rod leaves the slot via a lateral opening thereof while the covering rotates for a predetermined angle. At this time, the sash is disengaged with the rail to be moved off the window.

5 Claims, 17 Drawing Sheets

(51) Int. Cl.
*E06B 3/50* (2006.01)
*E06B 7/02* (2006.01)

(52) U.S. Cl.
CPC ..... *E05D15/0621* (2013.01); *E06B 3/50* (2013.01); *E06B 7/02* (2013.01)

(56) References Cited

U.S. PATENT DOCUMENTS 3,118,170 A * 1/1964 Zollinger ..... 16/105
3,138,474 A * 6/1964 Reiss et al. ..... 160/206
3,193,871 A * 7/1965 Foltz ..... 210/98
3,403,954 A * 10/1968 Williams ..... 312/351
3,479,682 A * 11/1969 McNinch ..... 16/97
3,692,083 A * 9/1972 Swanson et al. ..... 160/206
3,757,384 A * 9/1973 Rusch ..... 16/97
3,813,728 A * 6/1974 Johnson ..... 16/97
3,829,929 A * 8/1974 Foltz et al. ..... 16/97
4,945,605 A * 8/1990 Haab et al. ..... 16/97
6,209,171 B1 * 4/2001 Pelletier et al. ..... 16/97
6,983,512 B2 * 1/2006 De Oliveira ..... 16/97
7,117,559 B1 * 10/2006 Barber ..... 16/97
7,451,802 B2 * 11/2008 Cianciolo et al. ..... 160/211
8,046,872 B2 * 11/2011 Burgess et al. ..... 16/97
8,402,606 B1 * 3/2013 Tsai ..... 16/49
8,819,993 B1 * 9/2014 Chen ..... 49/125
2012/0186046 A1 * 7/2012 Pelekanos ..... 16/87 R

* cited by examiner

DETACHABLE HANGER FOR COVERING OF BUILDING'S OPENING

CROSS-REFERENCE TO RELATED APPLICATION

This is a continuation application of U.S. patent application Ser. No. 13/788,163 filed on Mar. 7, 2013.

BACKGROUND OF THE INVENTION

1. Field of the Invention

The present invention relates generally to a covering of a building's opening, and more particularly to a detachable hanger of a covering of a building's opening.

2. Description of the Related Art

A covering for an opening of a building, such as window or door, has various types. Take a window covering for example, the common type of the window covering has two sliding or hinged sashes. In this type of window covering, the sashes take some space of the window opening. It is bad for ventilation.

Another window covering is similar to a casement window, having two hinged sashes, one of which is pivoted on the frame, and the other one of which is slidably engaged with a rail. Slide the sash will fold the sashes. In this window covering, the rail is straight, and the sash can't be moved when the folded sashes fold up. A new window covering provides a warp rail, with which the folded sashes are moved off the window and attached to the wall beside the window. It is easy to understand that the warp rail is expensive and is difficult to manufacture. Furthermore, the warp rail makes the sashes move in a strange way. It is not good looking.

SUMMARY OF THE INVENTION

The primary objective of the present invention is to provide a method of opening a covering, which provides an easy way to engage and disengage the covering with a straight rail.

According to the objective of the present invention, a hanger for a covering of an opening of a building to detachably engage the covering with a rail on a sidewall of the opening, and the hanger includes a pulley assembly, which has a base and a plurality of pulleys mounted on the base for rotation, wherein the pulleys engage the rail so that the pulley assembly moves in the rail. The pulley assembly engages the covering to allow the covering to move in the rail, and the pulley assembly disengages the covering while the covering rotates for a predetermined angle.

In an embodiment, the hanger further includes restricting assembly to be moved between a first position and a second position. The restricting assembly holds an engagement of the rod and the slot when the restricting assembly is moved to the first position, and the restricting assembly is moved to the second position to allow the rod to disengage the slot while the covering rotates for the predetermined angle.

In an embodiment, a rod and a slot serve the engagement of the pulley assembly and the covering. The slot has a lateral opening, and the rod only leaves the slot via the lateral opening to disengage the pulley assembly and the covering.

In an embodiment, the restricting assembly is provided with a driving portion, which is driven by another covering to move the restricting assembly to the second position while the covering rotates for the predetermined angle.

In an embodiment, a biasing member is provided to temporarily fix the pulley assembly to the rail while the covering rotates for the predetermined angle.

Therefore, the hanger of the present invention may be incorporated in a straight rail, and make the sashes totally move off the window opening.

DETAILED DESCRIPTION OF THE INVENTION

The detailed description and technical contents of the present invention will be explained with reference to the accompanying drawings. However, the drawings are illustrative only but not used to limit the present invention.

Figure 5:
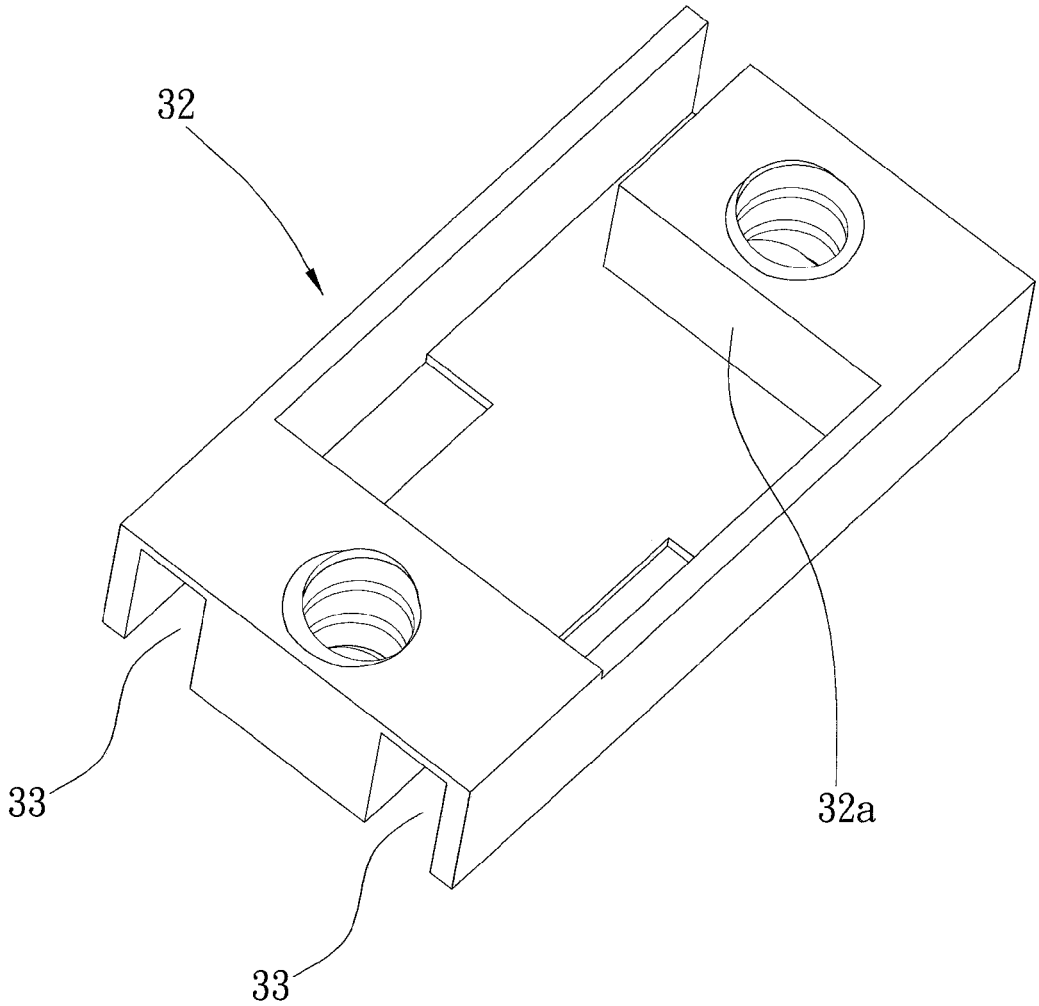
FIG. 5 is a perspective view of the supporting member of the first preferred embodiment of the present invention.
Figure 6:
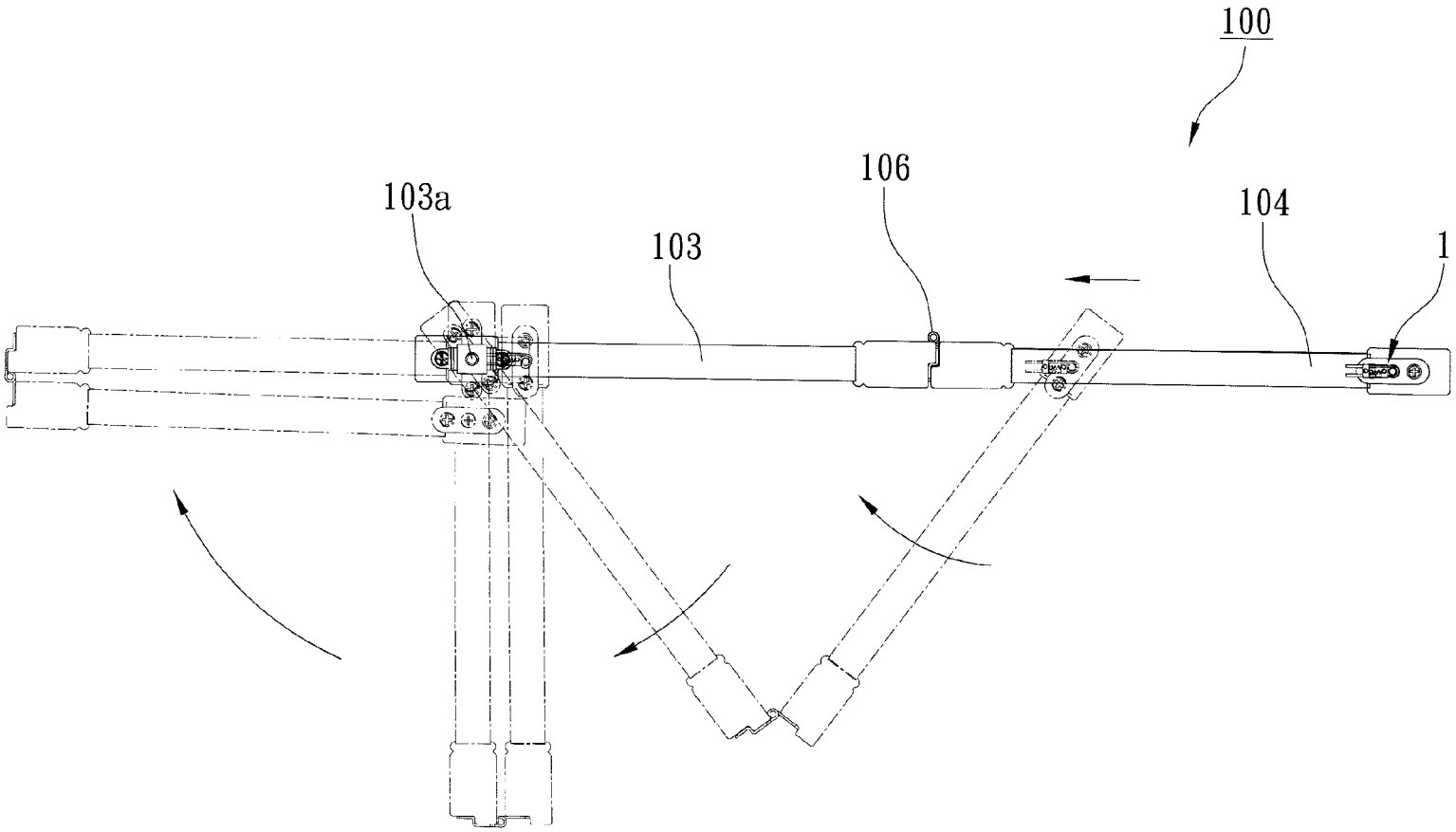
FIG. 6 is a top view of the window covering of the first preferred embodiment of the present invention, showing the movement of the sashes.

FIGS. from FIG. 1 to FIG. 5 show a detachable hanger 1, which is incorporated in a covering, such as window covering or door, of a building's opening, and we take a window covering 100 for example to describe the detachable hanger 1 of the present invention hereunder. The window covering 100 has a window frame 101, a straight rail 102, and two sashes 103, 104. The sash 103 is pivoted on the window frame 101 through a pin 103*a* (FIG. 6), and the sash 104 is connected to the sash 103 through a hinge 106 (FIG. 6). The sash 104 has a sash frame 105, and the sash frame 105 has a top side 105*a*.

The hanger 1 includes a pulley assembly 10, an engaging assembly 20, and a restricting assembly 30.

The pulley assembly 10 has a base 12 and a plurality of pulleys 14. The base 12 has a top section 12*a* and a bottom section 12*b*. The top section 12*a* and the bottom section 12*b* are connected through ribs, and therefore, a space S is formed between the top section 12*a* and the bottom section 12*b*. The pulleys 14 are mounted on the top section 12*a* for free rotation. The pulleys 14 engage the rail 102 so that the base 12 is able to move in the rail 102.

Figure 3:
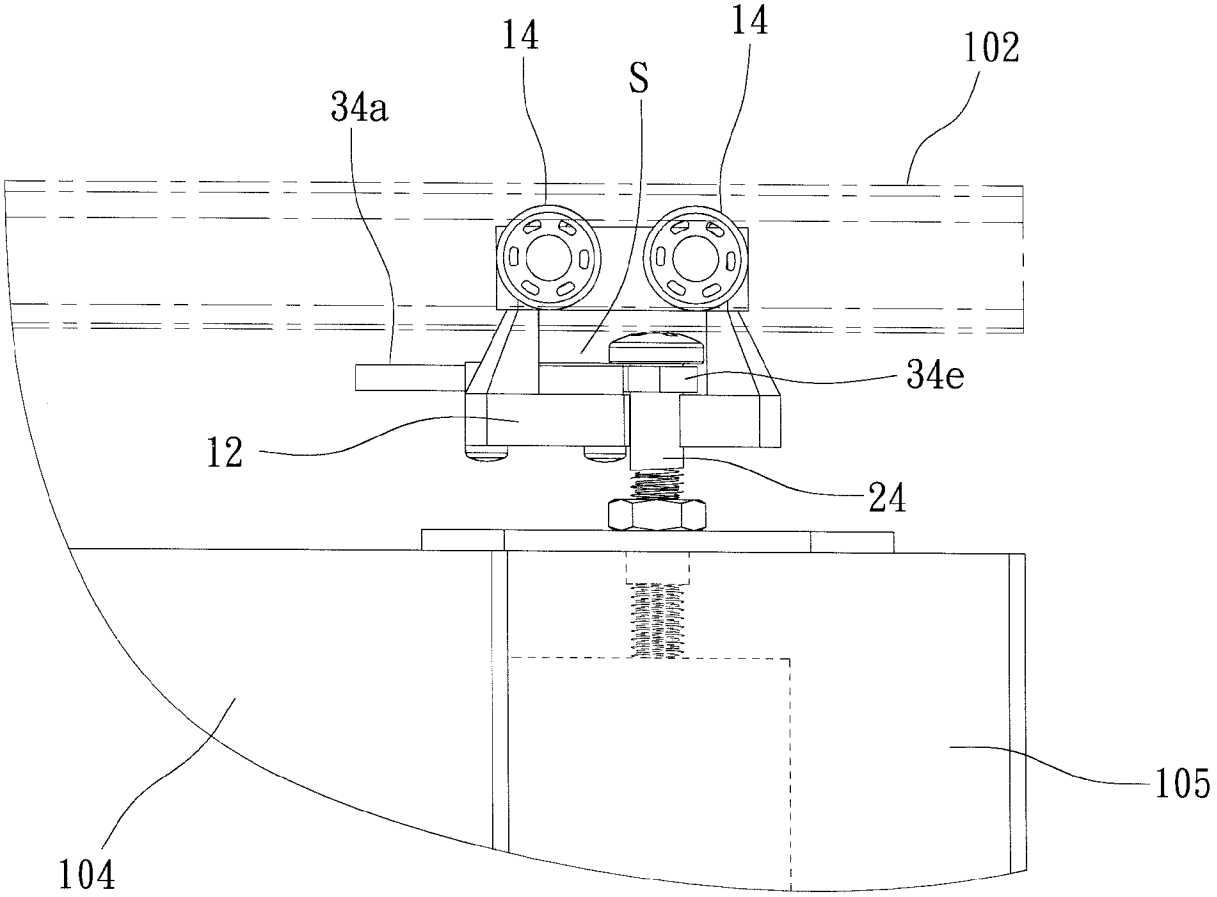
FIG. 3 is a front view of the first preferred embodiment of the present invention.
Figure 4:
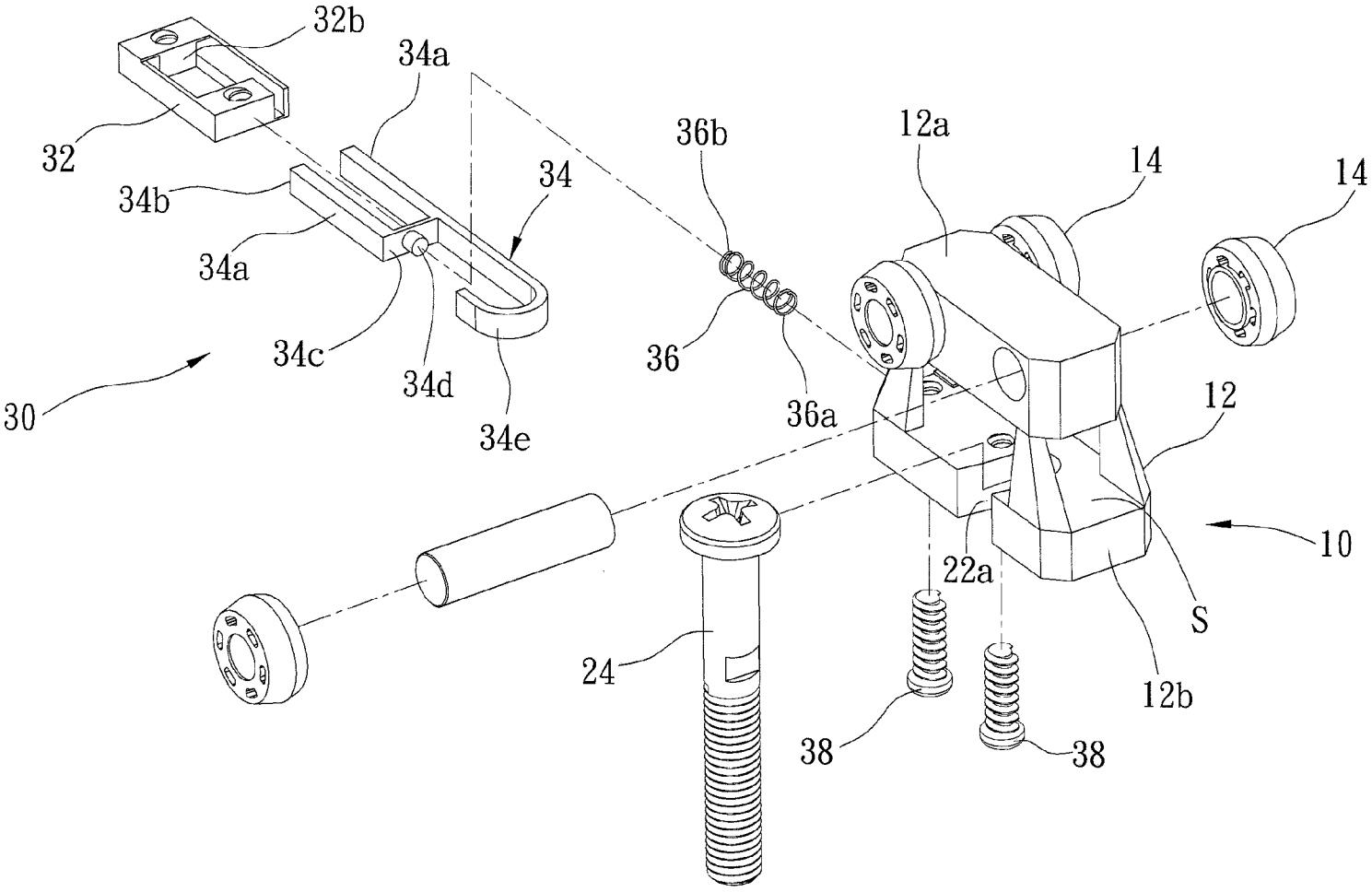
FIG. 4 is an exploded view of the first preferred embodiment of the present invention.

The engaging assembly 20 includes a slot 22 and a rod 24. The slot 22 is provided on the bottom section 12*b* of the base 12. The slot 22 is open at a top and a bottom of the bottom section 12*b* and has a lateral opening 22*a* at a lateral side of the bottom section 12*b*. The rod 24 is vertical and has an end fixed to the top side 105*a* of the sash frame 105. In an embodiment, the rod 24 is a bolt screwed into a thread hole on the sash frame 105 and engaging the slot 22, and a head of the rod 24 is in the space S, as shown in FIG. 3. The rod 24 is able to move together and within the slot 22 while the sash 104 is moving. The head is bigger than a width of the slot 22 so that the rod 24 only leaves the slot 22 via the lateral opening 22*a*.

The restricting assembly 30 has a supporting member 32, a switch 34, and an elastic member 36.

The supporting member 32 is a rectangular frame and is fixed to the top of the bottom section 12*b* of the base 12 through two blots 38, and therefore the supporting member 32 is in the space S. As shown in FIG. 5, the supporting member 32 has a recess, and a front stop portion 32*a* and a rear stop portion 32*b* are formed on opposite sidewalls of the recess. The supporting member 32 further has two openings 33 on a rear side thereof. The openings 33 extend through the rear stop portion 32*b*. A passageway is provided beside the front stop portion 32*a* to be an entrance of the recess, and the passageway is aligned with one of the opening 33.

The switch 34 movably engages the supporting member 32. The switch 34 has two parallel arms 34*a*, a base 34*c* connected to ends of the arms 34*a*, a protrusion 34*d* on the base 34*c* opposite to the arms 34*a*, and a hook 34*e* connected to the base 34*c* at the same side with the protrusion 34*d*. The base 34*c* is received within the recess of the supporting member 32 to be moved between the front stop portion 32*a* and the rear stop portion 32*b*. The arms 34*a* pass through the openings 33 and has distal ends extending out of the openings 33 to form an driving portion 34*b*. The hook 34*e* passes through the passageway to have a hook portion out of the supporting member 32.

In an embodiment, the elastic member 36 is a compression spring, having a first end 36*a* urging the front stop portion 32*a* and a second end 36*b* engaging the protrusion 34*d* of the switch 34 so that the elastic member 36 will be compressed while the switch 34 is forced toward the front stop portion 32*a*, and the elastic member 36 will return the switch 34 while the force is gone.

Figure 2:
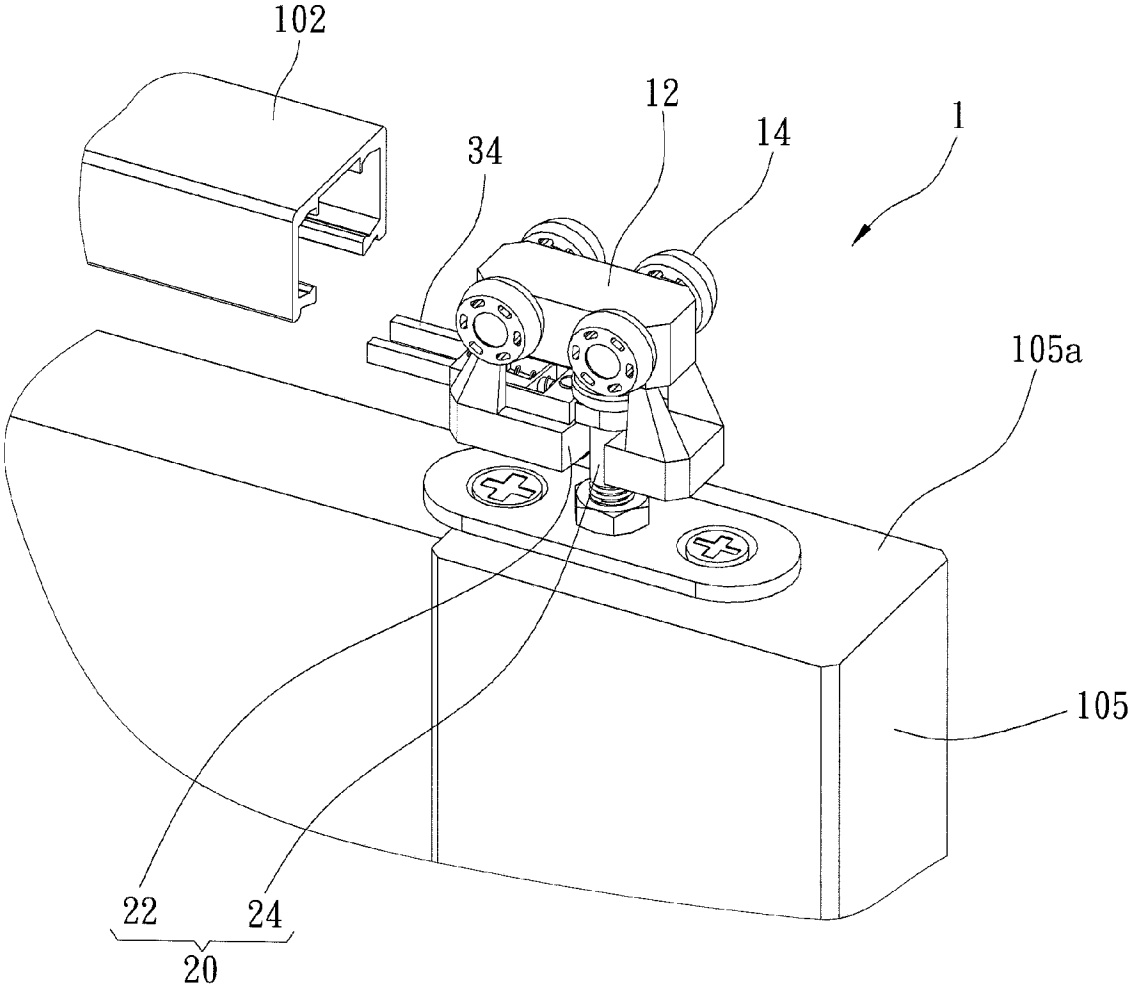
FIG. 2 is a perspective view of the first preferred embodiment of the present invention, showing the pulley assembly and the rail.
Figure 7:
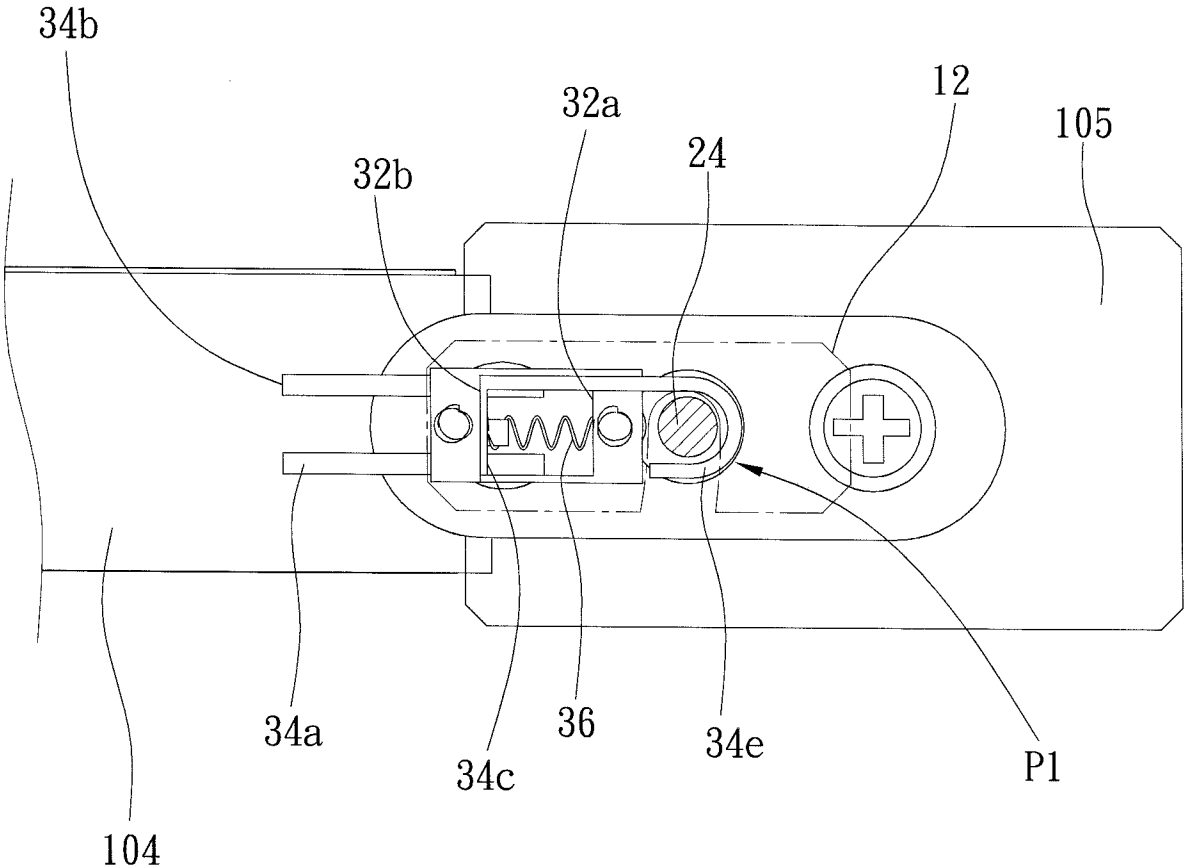
FIG. 7 is a top view of the first preferred embodiment of the present invention, showing the switch in the first position.

The solid lines in FIG. 6 show the sashes 103, 104 being expanded to close the window covering 100, in which, as shown in FIG. 2, FIG. 3, and FIG. 7, the rod 24 engages the slot 22 and is hooked by the hook 34*e* of the switch 34 to hold the rod 24 in the slot 22. We define that the switch 34 is moved to a first position P1 for above condition, and the elastic member 36 urges the switch 34 toward the first position P1.

Figure 8:
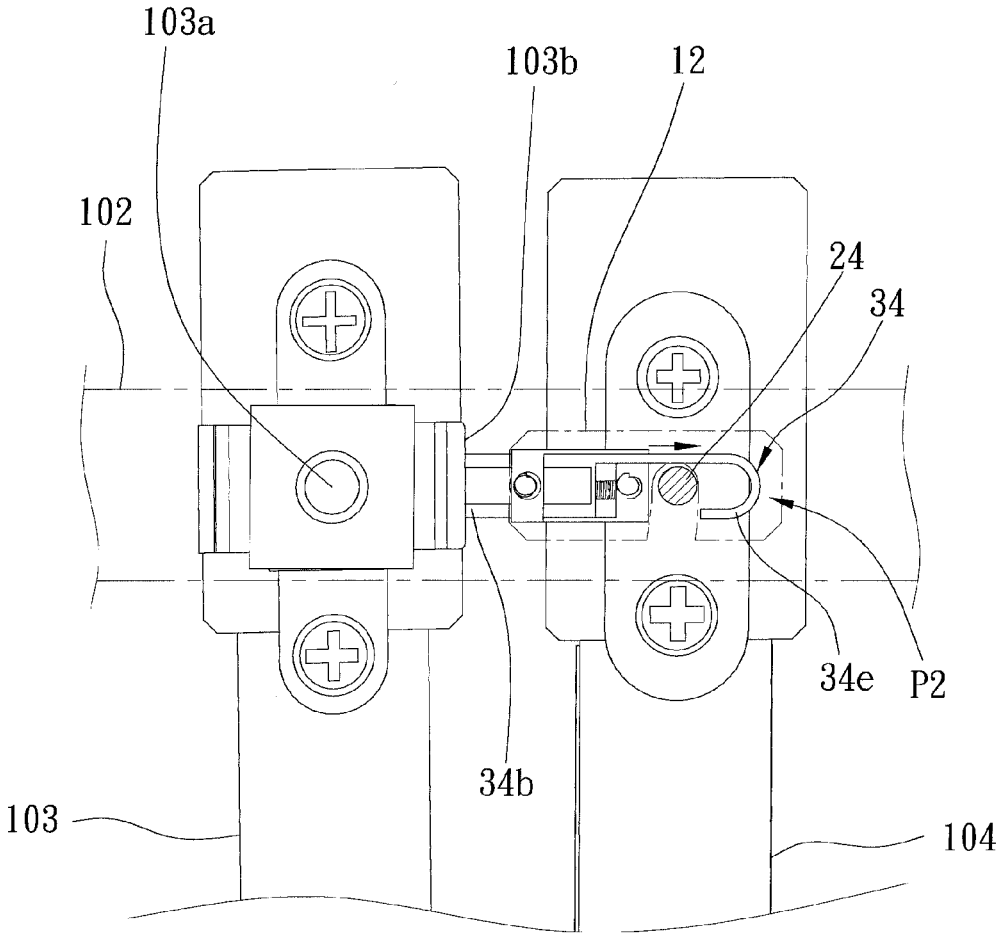
FIG. 8 is a top view of the first preferred embodiment of the present invention, showing the switch in the second position.

As shown in the dot lines of FIG. 6, when one draws the sash 104 to the left, the sashes 103, 104 rotate to fold up. In the beginning of drawing the sash 104, the hook 34*e* of the switch 34 still hooks the rod 24 to restrict the rod 24 in the slot 22. As the sash 104 keeps moving to the left, the driving portion 34*b* of the switch 34 will touch a portion 103*b* of the sash 103 eventually to move the switch 34 toward the front stop portion 32*a*. While the sashes 103, 104 are parallel, the rod 24 still is in the hook 34*e*, however, a gap of the hook 34*e* is aligned with the slot 22 (FIG. 8). We define that the switch 34 is moved to a second position P2 for above condition, and the rod 24 is able to leave the slot 22.

It is noted that the driving portions 34*b* of the switch 34 and the portion 103*b* of the sash 103 may be provided with magnets to temporarily hold the sashes 103, 104 in folded condition.

Figure 1:
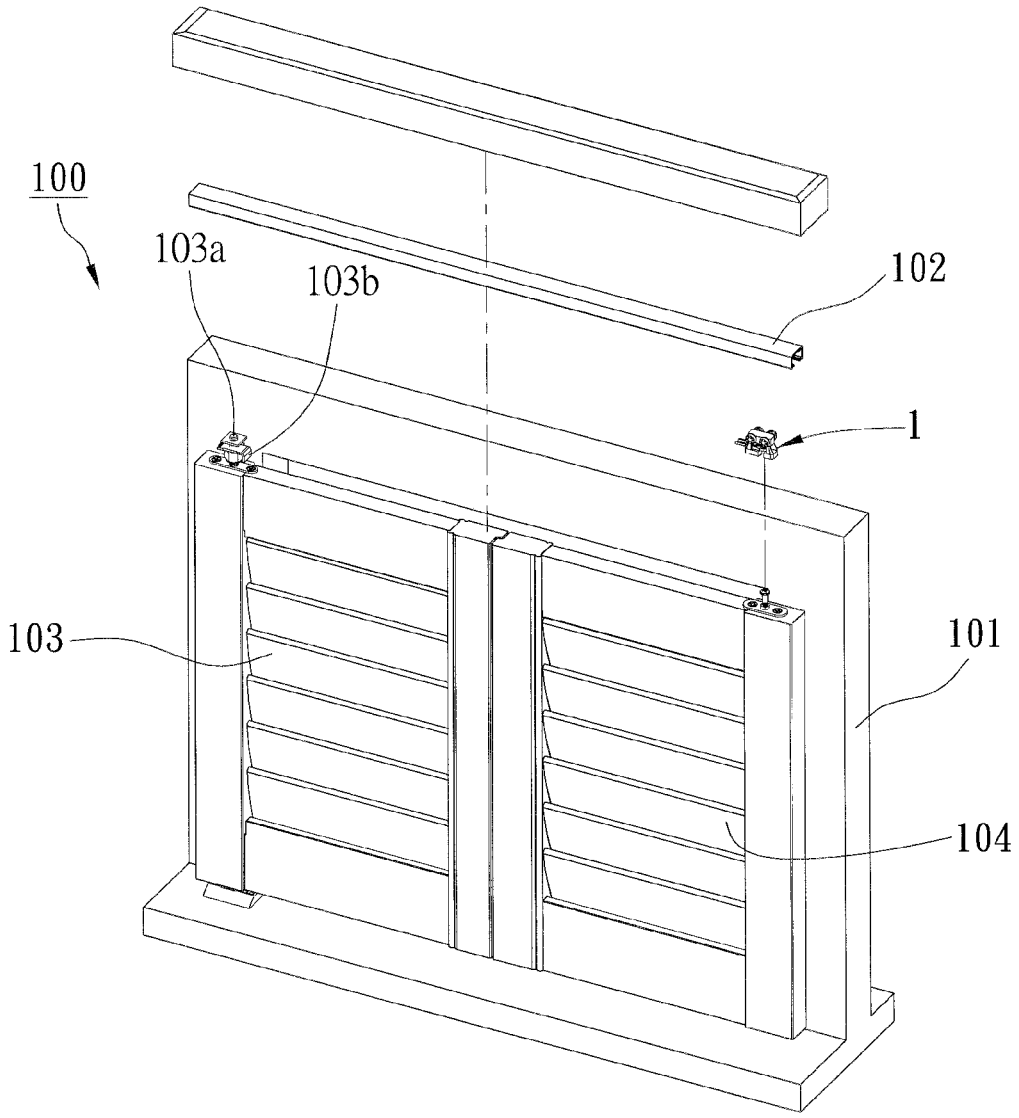
FIG. 1 is a perspective view of a first preferred embodiment of the present invention, showing the hanger incorporated in a window.
Figure 9:
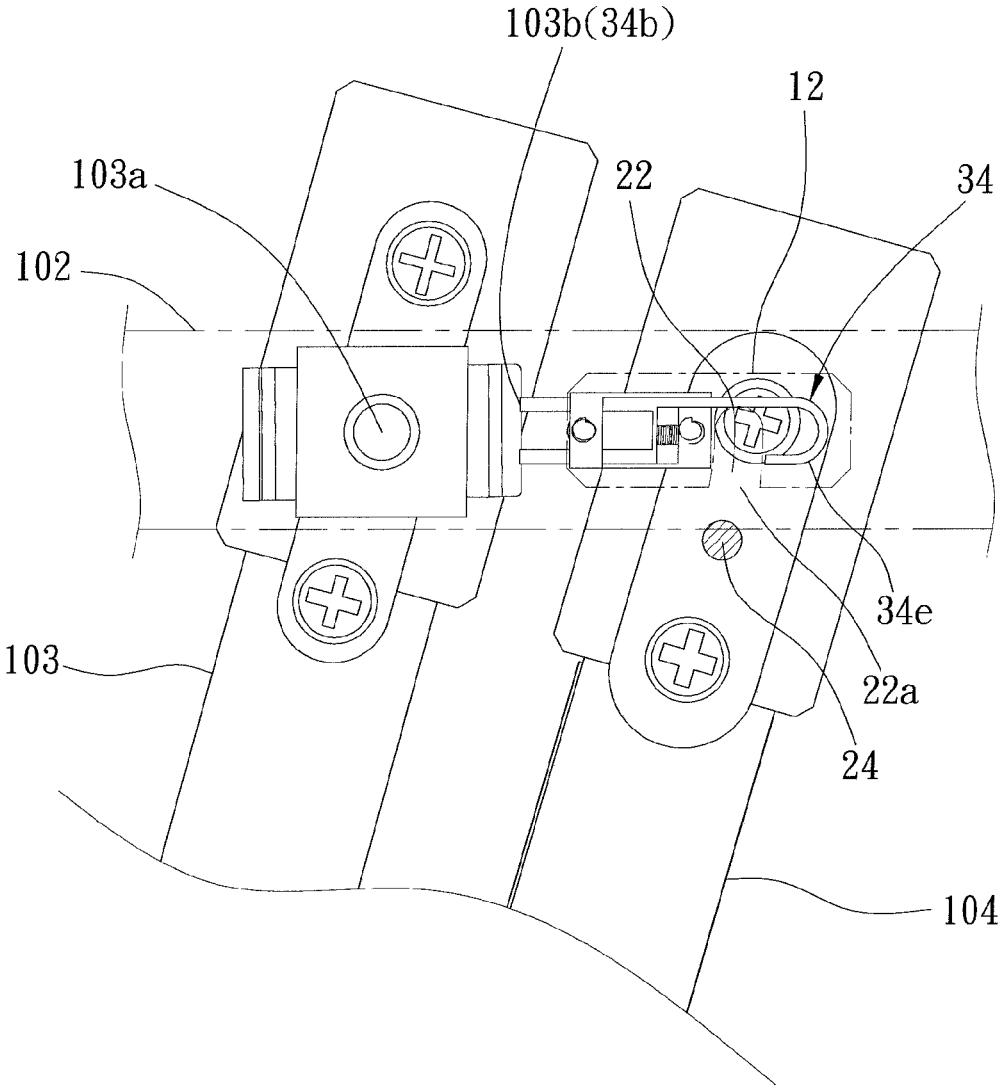
FIG. 9 is a top view of the first preferred embodiment of the present invention, showing the rod disengages the slot while rotate the folded sashes.
Figure 10:
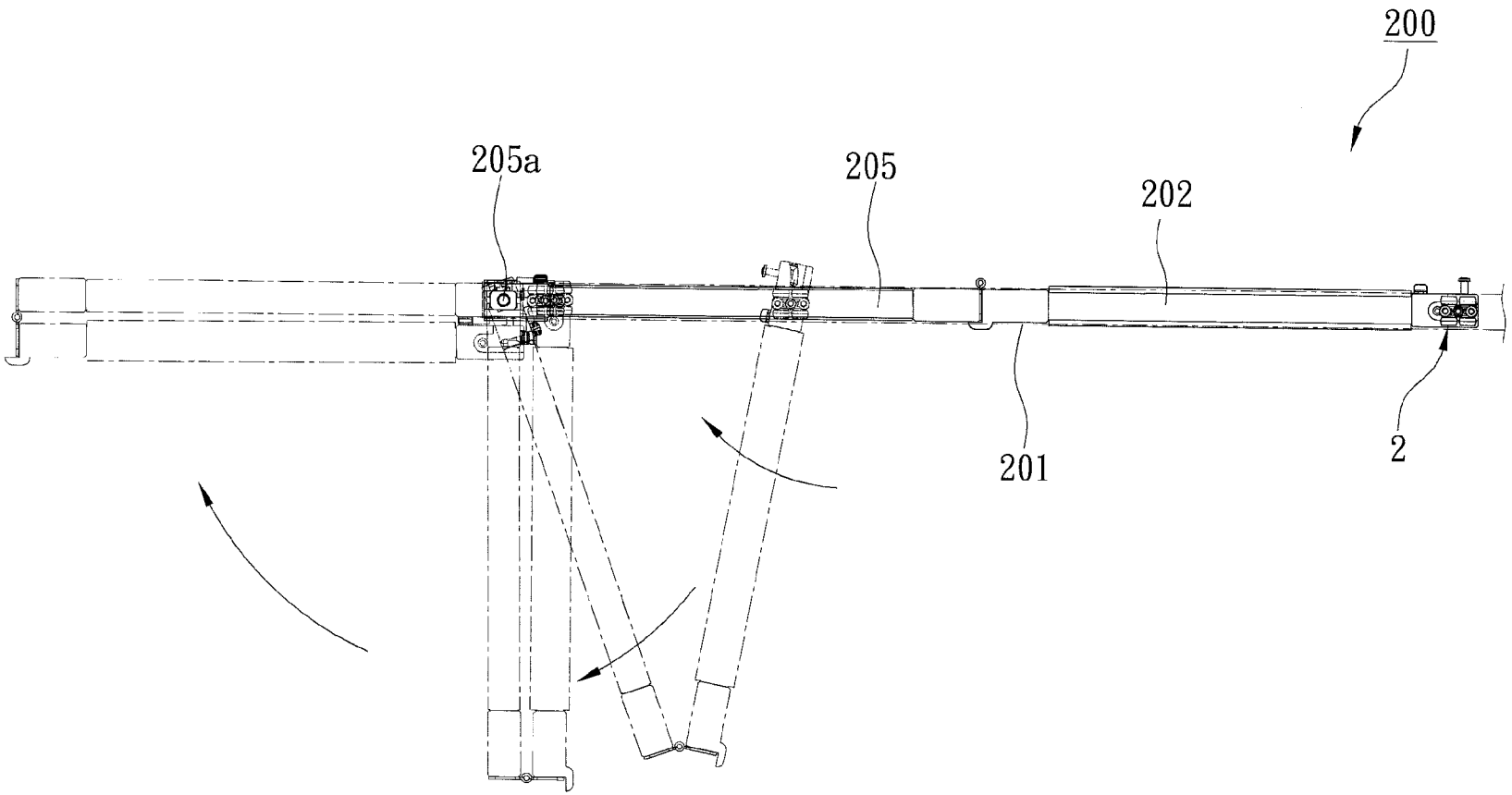
FIG. 10 is a top view of the window covering of a second preferred embodiment of the present invention, showing the movement of the sashes.
Figure 11:
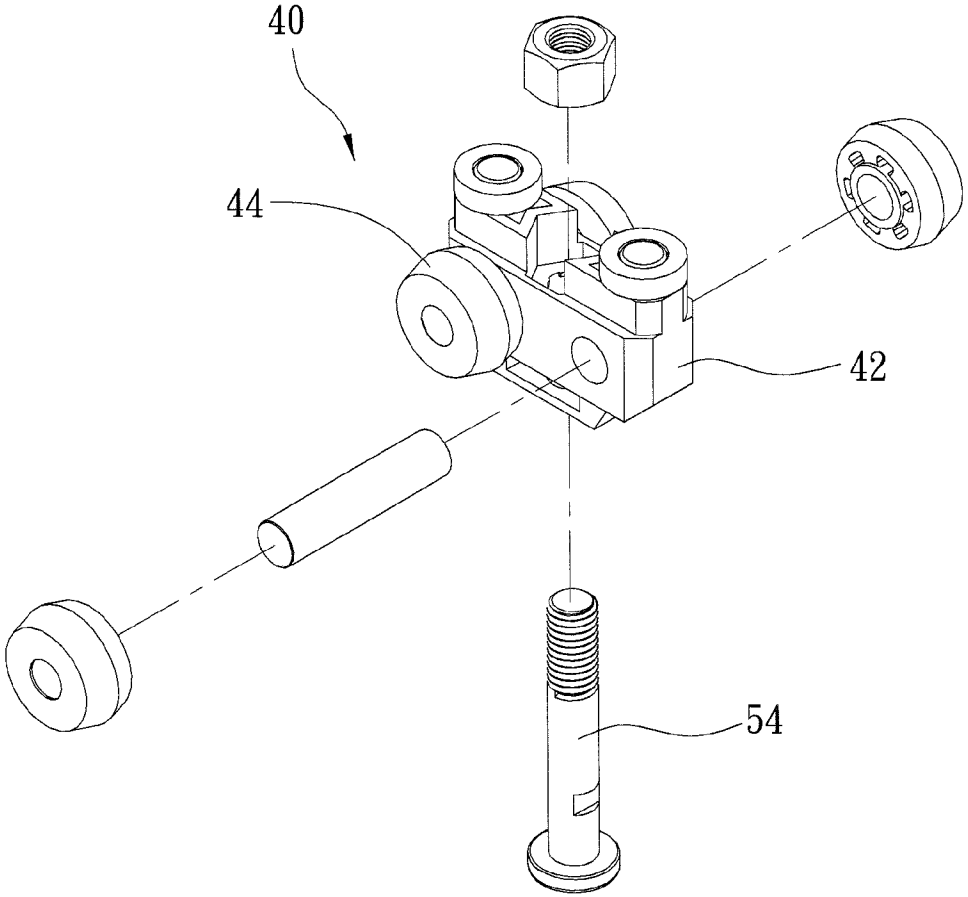
FIG. 11 is an exploded view of the second preferred embodiment of the present invention.
Figure 12:
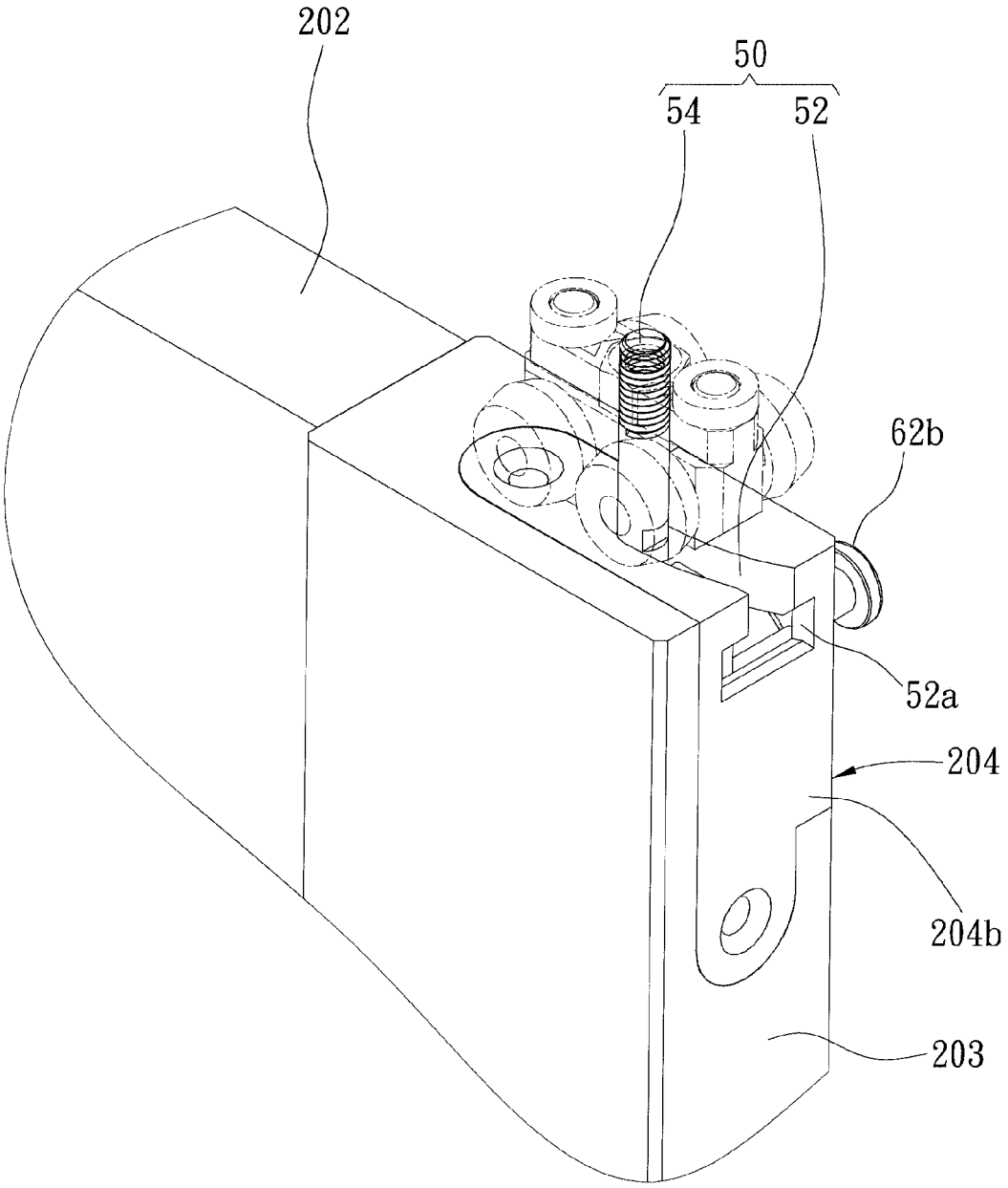
FIG. 12 is a perspective view of the second preferred embodiment of the present invention, showing the pulley assembly on the sash.
Figure 13:
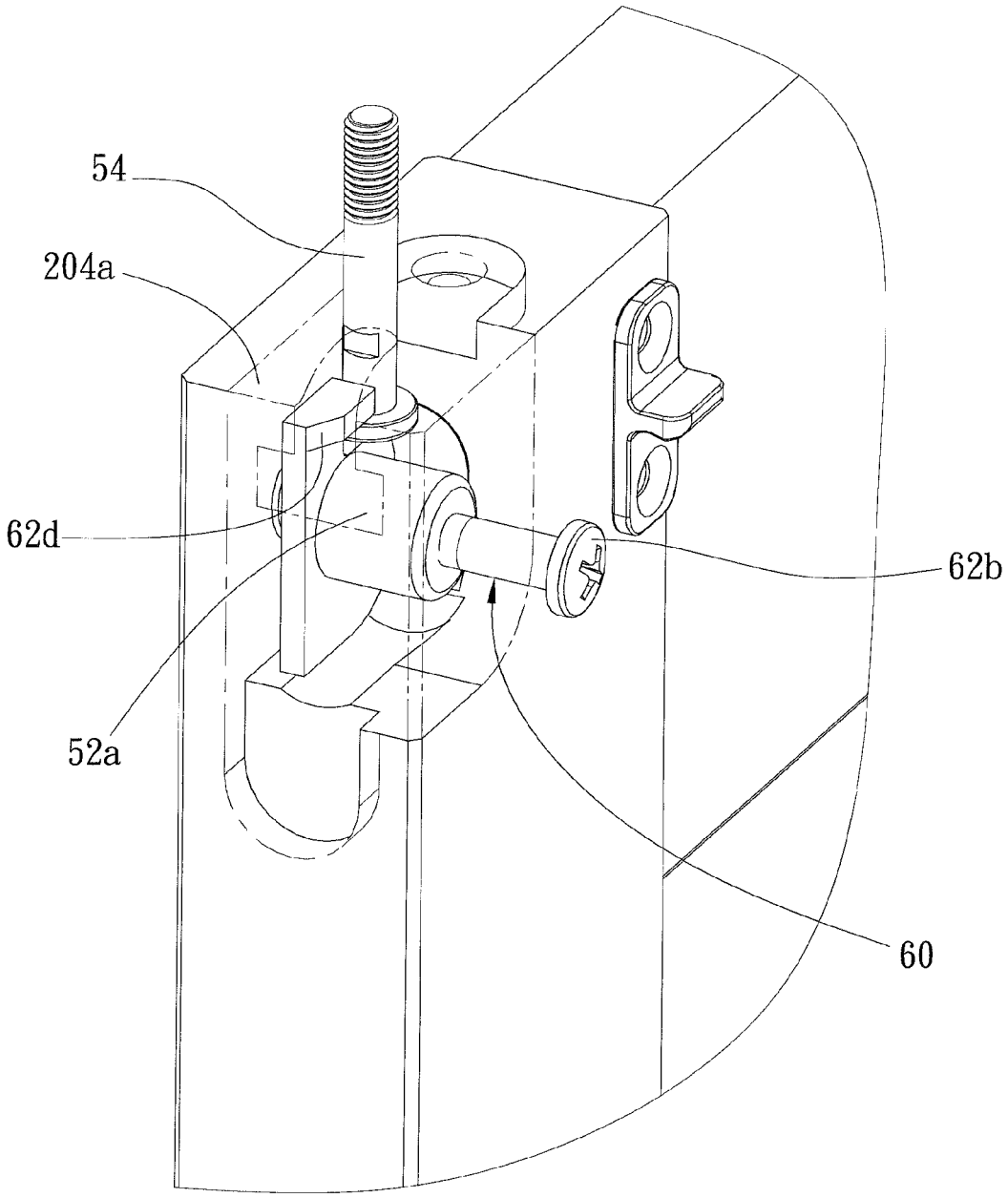
FIG. 13 is another perspective view of the second preferred embodiment of the present invention, showing the pulley assembly on the sash.

Next, when one rotates the folded sashes 103, 104 to the left (FIG. 9), the rod 24 will move off the slot 22 through the lateral opening 22*a* to disengage the hanger 10 with the rail 102. As a result, the sash 104 is free to be moved off the rail 102, and the sashes 103, 104 may be moved onto a wall beside the window. On the contrary, the sashes 103, 104 may be moved back from the wall to re-engage the sash 104 with the rail 102 in a reverse way, and that will make the sashes 103, 104 to move in the rail 102 again, and finally move the sashes 103, 104 back to close the window covering 100 as shown in FIG. 1.

Instead of an arched rail, the present invention provides the detachable hanger 1 on a straight rail 102. It has the same function as the arched rail to move the sashes totally off the window, but still keeps a straight movement while the sashes are still in the rail 102.

FIGS. from FIG. 10 to FIG. 13 show a detachable hanger 2 of the second preferred embodiment, which is incorporated in a window 200 with two sashes 202, 205. The hanger 2 includes a pulley assembly 40, an engaging assembly 50, and a restricting assembly 60.

The pulley assembly 40 has a base 42 and a plurality of pulleys 44 mounted on the base 42 for free rotation. The pulleys 44 engage a rail 201 on the window covering 200 so that the base 42 is able to move in the rail 201.

Figure 14:
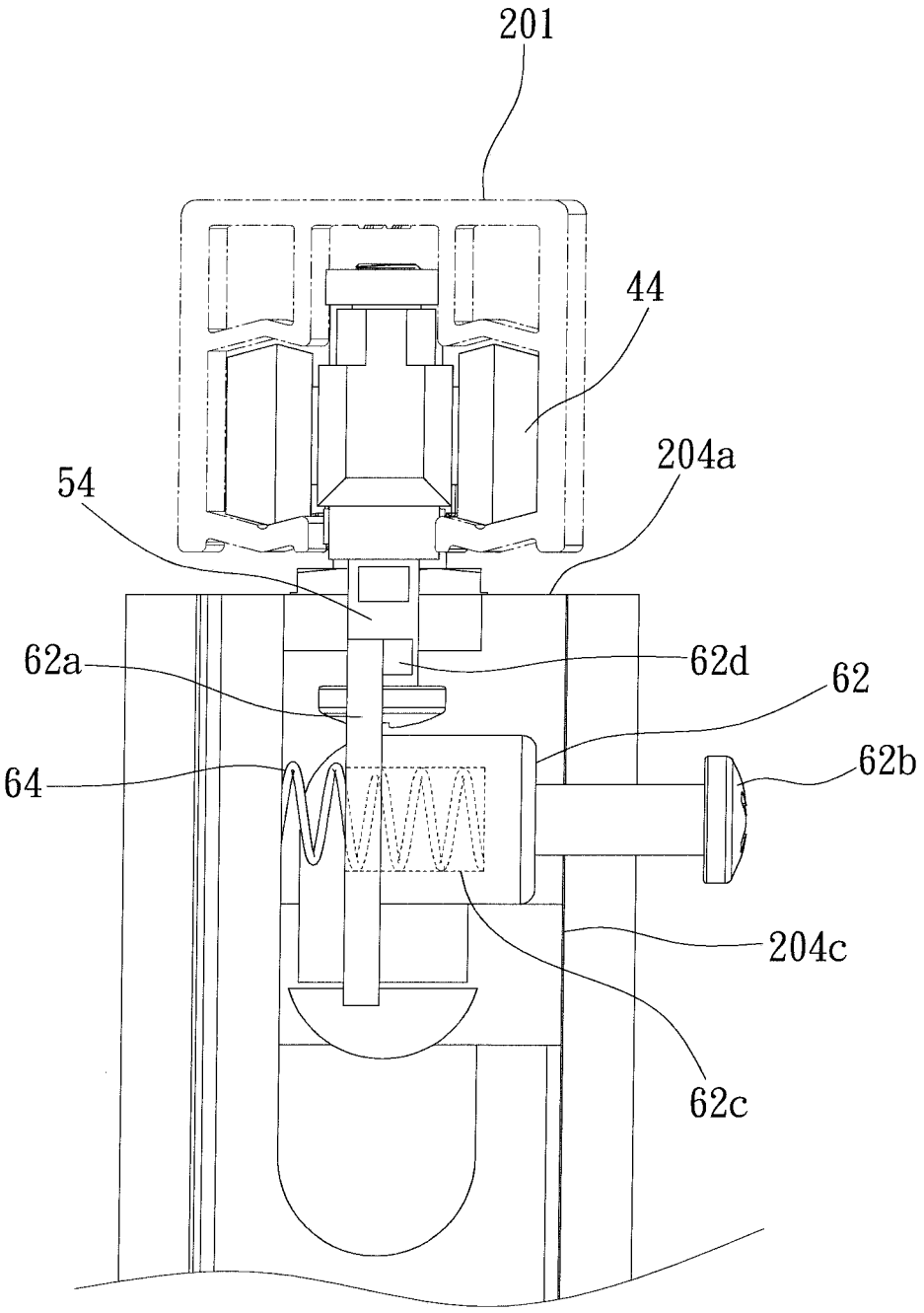
FIG. 14 is a side view of the second preferred embodiment of the present invention.

The engaging assembly 50 has a slot 52 and a rod 54. The slot 52 is provided on a sash frame 203 of the sash 202. In an embodiment, the sash frame 203 is provided with a recess at a corner thereof, and a lid 204 is fixed to the sash frame 203 to cover the recess. The lid 204 has a top portion 204*a* and a lateral portion 204*b* on a top edge and a lateral edge of the sash frame 203. The lid 204 further has a side portion 204*c*, which is vertical to both the top portion 204*a* and the lateral portion 204*b*, on a front side of the sash frame 203. The slot 52 is a curved slot extending on the top portion 204*a* of the lid 204. The slot 52 extends to the lateral portion 204*b* to form a lateral opening 52*a* thereon. The rod 54 has an end fixed to the base 42 and an opposite end engaging the slot 52, as shown in FIG. 14. In an embodiment, the rod 54 is a bolt screwed into a thread hole of the base 42. The rod 54 has a head bigger than a width of the slot 52 on the top portion 204*a*, and the lateral opening 52*a* is bigger than the diameter of the rod 54, so that the rod 54 will move in the slot 52 and leave the slot 52 via the opening 52*a* only.

The restricting assembly 60 has a switch 62 and an elastic member 64, both of which are provided in recess of the sash frame 203 of the sash 202 and is under the lid 204. The switch 62 has a stop portion 62*a* and a driving portion 62*b* on opposite sides. The driving portion 62*b* extends out of the sash frame 203 via the side portion 204*c*. The switch 62 further has a bore 62*c* and an inclined face 62*d* on the stop portion 62*a*. The inclined face 62*d* faces the opening 52*a*. The elastic member 64, which can be a compression spring as well, has an end urging an inner side of the sash frame 203 and an opposite end entering the bore 62*c* to urge the switch 62 outwardly.

Similar to the first preferred embodiment, when the sashes 202, 205 expand to close the window covering 200, the rod 54 is restricted by the stop portion 62*a* of the switch 62 and stays in the slot 52. We define it that the switch 62 is in a first position.

Figure 15:
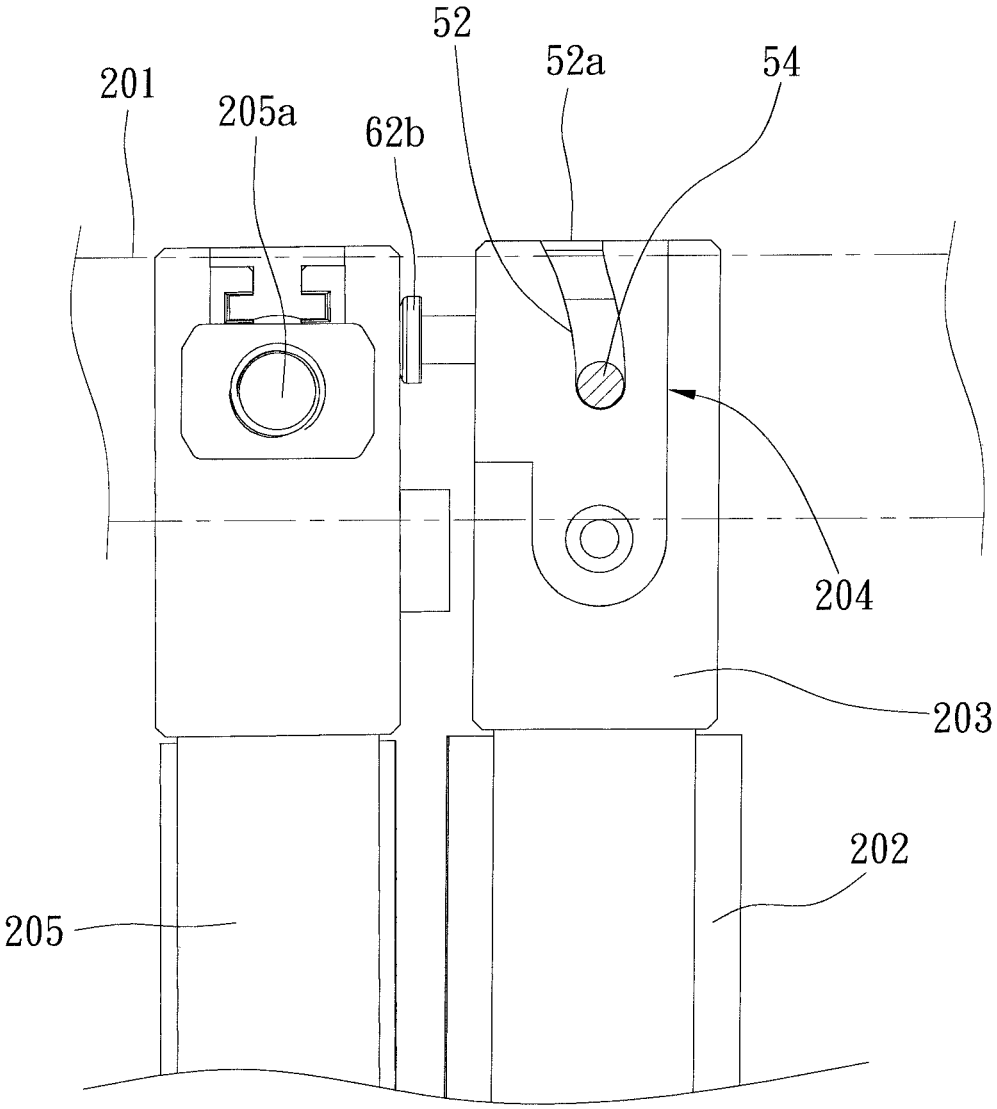
FIG. 15 is a top view of the second preferred embodiment of the present invention, showing the driving portion of the switch touches the other sash while the sashes are parallel and vertical to the rail.

While one moves the sash 202 toward the sash 205, the hinged sashes 202, 205 rotate, and the driving portion 62*b* of the switch 62 will touch sash 205 while the sashes 202, 205 are parallel and vertical to the rail 201. At this time, the switch 62 will be moved to a second position, in which the elastic member 64 is compressed, and the stop portion 62*a* leaves the slot 52 open to free the rod 54, as shown in FIG. 15 and FIG. 16.

Figure 17:
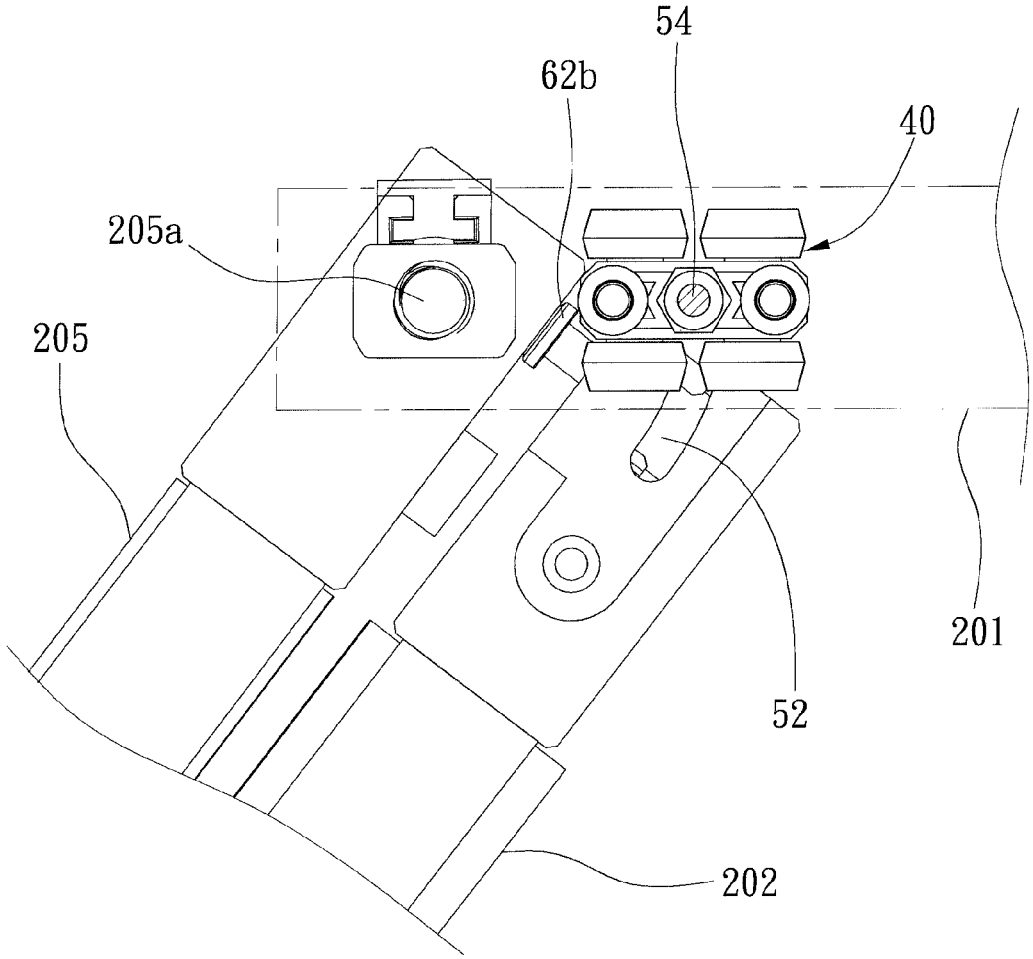
FIG. 17 is a top view of the second preferred embodiment of the present invention, showing the rod disengages the slot while rotate the folded sashes.

Next, one moves the sashes 202, 205 to make them rotate along a pin 205*a*. At this time, the rod 54 will leave the slot 52 via the opening 52*a* to disengage the hanger 2 with the sash 202 (FIG. 17). One may move the sashes 202, 205 totally off the window opening and attach them to a wall beside the window opening.

On the contrary, the sashes 202, 205 may be moved back in a reverse way to make the rod 54 enter the slot 52 via the opening 52*a* that may reengage the sash 202 with the rail 201 again. As a result, the sashes 202, 205 may move in the rail 201 to close the window covering 200.

Figure 16:
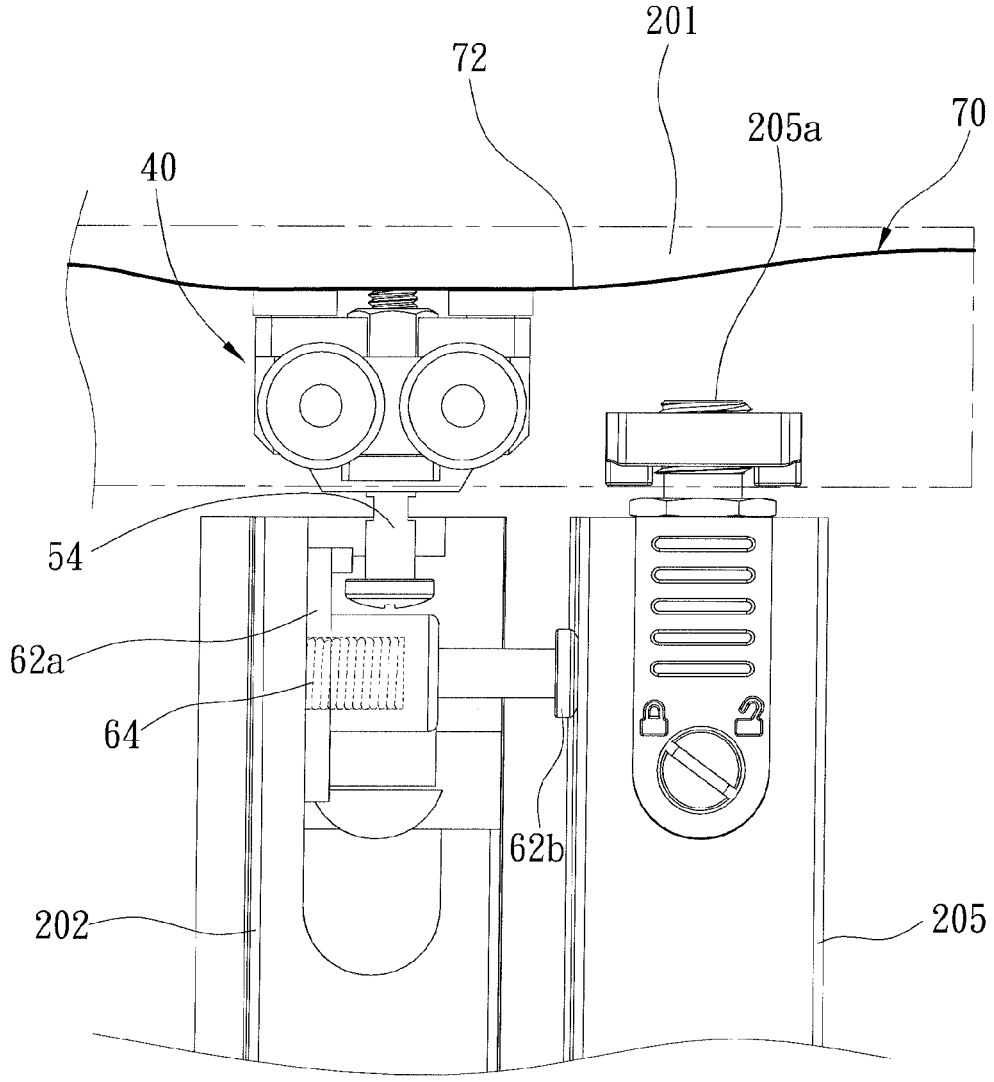
FIG. 16 is a side view of the second preferred embodiment of the present invention, showing the switch in the second position.

As shown in FIG. 16, a biasing member 70 is provided in the rail 201. The biasing member 70 is a flexible elongated plate having a flexible portion 72 at a center thereof. While the sash 202 is moved to a position where the sash 202 is about to be disengaged with the rail, the pulley assembly 40 is right under the biasing member 70 and the biasing member 70 presses the pulley assembly 40 onto the rail 201. As a result, the pulley assembly 40 will be temporarily held right there to wait for the sash 205. The biasing member 70 may be incorporated in the rail 102 of the first preferred embodiment in the same way.

The description above is only a few preferred embodiments of the present invention and the equivalence of the present invention is still in the scope of claim construction of the present invention.

What is claimed is:

1. A method of opening a covering for an opening of a building, wherein the covering includes a rail, a first sash, a second sash, and a pulley assembly; the first sash and the second sash are pivoted with each other, and an end of the second sash is fixedly pivoted on the rail; the pulley assembly is movably received in the rail, and an engaging assembly is provided between the first sash and the rail to engage the first sash with the rail and let the first sash be able to move along the rail; the engaging assembly includes a slot and a rod, wherein the rod is provided on either the first sash or the pulley assembly, while the slot is correspondingly provided on the other, and the slot has a lateral opening; a restricting assembly is provided on the engaging assembly, and includes a driving portion; the restricting assembly leaves the lateral opening open to allow the rod to enter and leave the slot while the driving portion is pressed, and closes the lateral opening while the driving portion is unpressed; when the covering closes the opening of the building, the rod is received in the slot, the lateral opening is closed, and the first sash and the second sash are in the opening and parallel to the rail; the method comprising the steps of:

moving the first sash toward the second sash, till the first and the second sashes are folded, wherein the driving portion of the restricting assembly is pressed by the second sash when the first sash and the second sash are folded to open the lateral opening of the slot of the engaging assembly; and continuously moving the first sash and the second sash altogether to move the rod out of the slot via the lateral opening and disengage the first sash with the rail, till the first sash and the second sash are beyond the opening of the building and substantially parallel to the rail.

2. The method as defined in claim 1, wherein the lateral opening of the slot is closed before the first sash and the second sash are folded to restrict the rod in the slot.

3. The method as defined in claim 1, wherein the first sash and the second sash are kept in a folded condition to keep the lateral opening opened while the first sash and the second sash are being continuously moved.

4. The method as defined in claim 1, wherein the restricting assembly further includes a switch; the switch is connected to the driving portion, and moved from a first position to a second position when the driving portion is pressed; the switch engages the rod while the switch is moved to the first position, and the switch disengages the rod while the switch is moved to the second position.

5. The method as defined in claim 1, wherein the restricting assembly has a switch to be moved between the first position and the second position, and the switch has a stop portion; the stop portion is between the rod and the lateral opening of the slot while the switch is moved to the first position; and the stop portion is moved off the slot while the switch is moved to the second position; the stop portion has an inclined face facing the lateral opening of the slot.

* * * * *